US006670845B1

(12) United States Patent
Fong

(10) Patent No.: US 6,670,845 B1
(45) Date of Patent: Dec. 30, 2003

(54) HIGH D.C. VOLTAGE TO LOW D.C. VOLTAGE CIRCUIT CONVERTER

(75) Inventor: David Fong, Cupertino, CA (US)

(73) Assignee: Silicon Storage Technology, Inc., Sunnyvale, CA (US)

( * ) Notice: Subject to any disclaimer, the term of this patent is extended or adjusted under 35 U.S.C. 154(b) by 0 days.

(21) Appl. No.: 10/197,281

(22) Filed: Jul. 16, 2002

(51) Int. Cl.[7] ..... G05F 3/24
(52) U.S. Cl. ..... 327/541; 327/543; 323/313
(58) Field of Search ..... 327/513, 540, 327/541, 543; 323/313, 907

(56) References Cited

U.S. PATENT DOCUMENTS 4,453,121 A * 6/1984 Noufer ..... 323/313
4,692,689 A * 9/1987 Takemae ..... 323/313
5,552,740 A * 9/1996 Casper ..... 327/541
5,717,324 A * 2/1998 Tobita ..... 323/313
5,789,808 A * 8/1998 Yamasaki et al. ..... 327/540
5,955,874 A * 9/1999 Zhou et al. ..... 327/543
6,351,179 B1 * 2/2002 Ikehashi et al. ..... 327/541
6,437,614 B1 * 8/2002 Chen ..... 327/538

* cited by examiner

*Primary Examiner*—Timothy P. Callahan
*Assistant Examiner*—Terry L. Englund
(74) *Attorney, Agent, or Firm*—Ronald L. Yin; Gray Cary Ware & Freidenrich, LLP

(57) ABSTRACT

A high DC voltage to low DC voltage circuit has a first NMOS transistor with the first terminal connected to the source of the high DC voltage and the second terminal connected to supply the low DC voltage. The gate is connected to a middle node of a resistor divider circuit having one end connected to the source of the high DC voltage and the other end to a common node. A plurality of serially connected NMOS transistors has a first end connected to the common node and a second end connected to ground. Each of the NMOS transistors in the plurality of serially connected NMOS transistors has its gate connected to its first terminal and to the second terminal of the immediate adjacent NMOS transistor.

10 Claims, 1 Drawing Sheet

HIGH D.C. VOLTAGE TO LOW D.C. VOLTAGE CIRCUIT CONVERTER

TECHNICAL FIELD

The present invention generally relates to a circuit for converting high DC voltage to low DC voltage and more particularly to a semiconductor integrated circuit.

BACKGROUND OF THE INVENTION

Semiconductor integrated circuit devices are well known in the art. Typically, they are constructed in a semiconductor substrate and powered by an external DC power source. A typical externally supplied voltage is 3.3 volts. However, as the scale of integration increases and the dimensions of the critical components of the active elements within a circuit decreases due to increased shrinkage of the semiconductor integrated circuit, the voltage that can cause breakdown of the various components also decreases. Thus, these integrated circuits must be operated at a lower DC voltage.

Where the semiconductor integrated circuit components have shrunk such that the operating voltage is lowered to e.g. 1.8 volts, but the semiconductor integrated device must still fit in a "socket" designed to operate at 3.3 volts, a high DC voltage to low DC voltage converter circuit must be used to convert the externally supplied 3.3 volts to an internal DC voltage of 1.8 volts. Although high DC voltage to low DC voltage converters are well known in the art, they have shortcomings which are addressed by the circuit converter of the present invention.

SUMMARY OF THE INVENTION

Accordingly, in one non-limiting aspect of the present invention, a high DC voltage to low DC voltage circuit converter comprises a first NMOS transistor having a first terminal, a second terminal and a gate for controlling the flow of current between the first terminal and the second terminal. The first terminal is connected to the high DC voltage and the second terminal provides the converted low DC voltage. A resistor divider circuit has a first node, a middle node, and a second node. The first node is also connected to the high DC voltage. The middle node is connected to the gate of the first NMOS transistor. A plurality of serially connected NMOS transistors has a first end and a second end with the first end connected to the second node, and the second end connected to ground. Each of the plurality of serially connected NMOS transistors has a first terminal, a second terminal and a gate for controlling the flow of current between the first terminal and the second terminal. The first terminal of one NMOS transistor is connected to its gate and to a second terminal of an adjacent NMOS transistor.

DETAILED DESCRIPTION OF THE INVENTION

Figure 1:
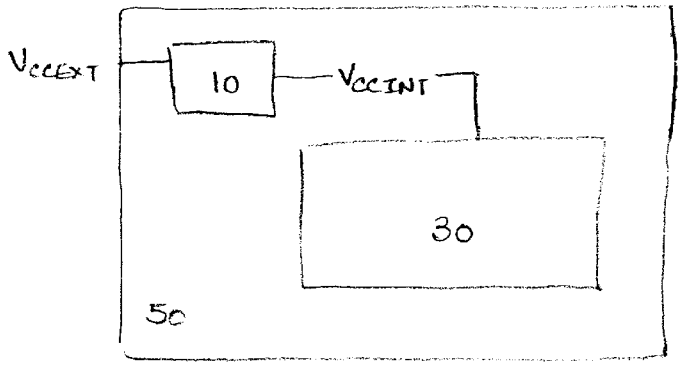
FIG. 1 is a schematic block level diagram of an integrated circuit device having the high DC voltage to low DC voltage circuit of the present invention, as well as an integrated circuit to which the generated low DC voltage is supplied.

Referring to FIG. 1, there is shown a block level diagram of a semiconductor integrated circuit device 50 with the high DC voltage to low DC voltage circuit 10 of the present invention. The semiconductor integrated circuit device 50 is typically made from a semiconductor substrate having many circuit elements constructed thereon. It is connected to receive an externally supplied high DC voltage designated at Vccext. The externally supplied DC voltage Vccext is supplied to the high DC voltage to low DC voltage circuit converter 10 of the present invention, which generates a low DC voltage designated as Vccint. The low DC voltage Vccint which is the output of the circuit converter 10 of the present invention is supplied to a second circuit 30 of the integrated circuit device 50.

In one typical application of the circuit converter 10 of the present invention, the integrated circuit device 50 is an SRAM memory device or an embedded SRAM memory product with logic circuit and the second circuit 30 which receives the low DC voltage Vccint is an SRAM memory cell array. The circuit converter 10 receives an externally supplied high DC voltage Vccext, such as 3.3 volts, and generates an internally supplied low DC voltage Vccint, such as 1.8 volts. Other portions of the integrated circuit device 50 will continue to receive the device 50 is made of thin oxide and thus a lower DC voltage must be used. The oxide in the memory circuit portion 30 is thinner in comparison to the oxide in the rest of the integrated circuit device 50.

Figure 2:
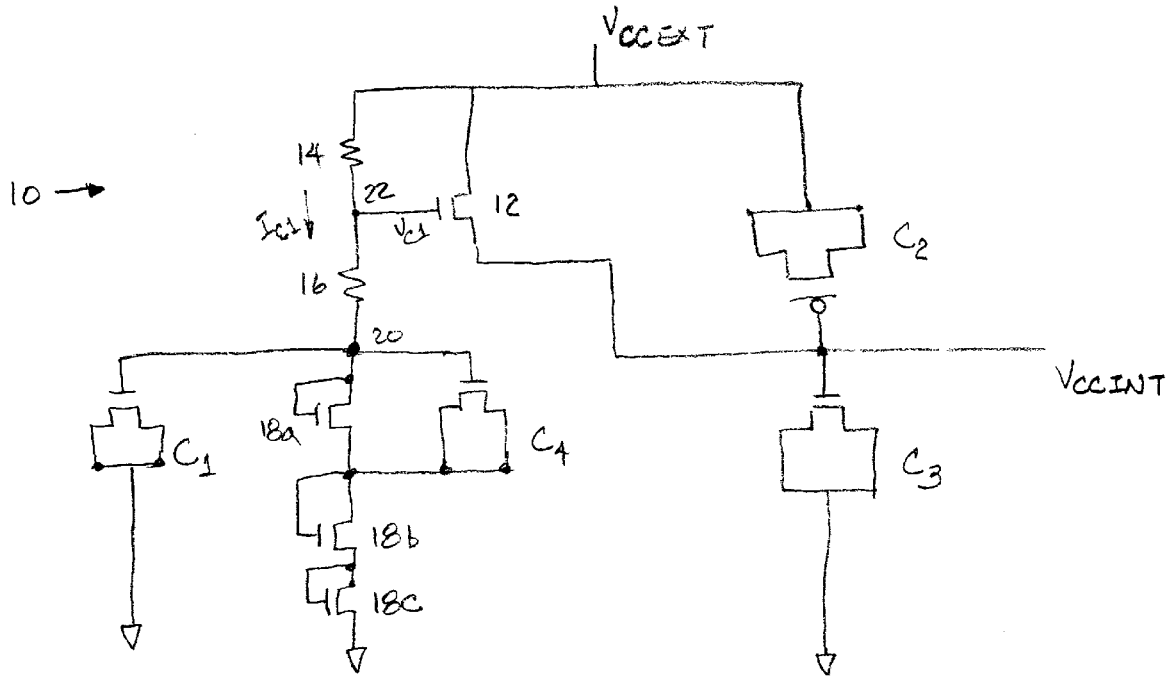
FIG. 2 is a detailed circuit diagram of the preferred embodiment of the high DC voltage to low DC voltage circuit of the present invention.

Referring to FIG. 2, there is shown a detailed circuit diagram of the circuit converter 10 of the present invention. The circuit converter 10 has a first NMOS transistor 12 having a first terminal, a second terminal and a gate for controlling the flow of current between the first terminal and the second terminal. The first terminal is connected to Vccext and receives the externally supplied high DC voltage. The second terminal is connected to Vccint and provides the generated low DC voltage as the output of the circuit converter 10.

A resistor divider circuit comprising of a first resistor 14 and a second resistor 16 has a first end connected to Vccext and a second end connected to node 20. The first resistor 14 and the second resistor 16 are serially connected at a middle node 22 there between. The middle node 22 is connected to the gate of the first NMOS transistor 12. As will be shown, in the preferred embodiment the first resistor 14 and the second resistor 16 are both made in an N-well in a semiconductor p type substrate or in a semiconductor p type well.

A plurality of serially connected NMOS transistors designated 18*a*, 18*b*, 18*c*, etc. is connected between node 20 and ground. Each of the NMOS transistors 18(*a*–*c*) in the chain of serially connected NMOS transistors has a first terminal, a second terminal and a gate for controlling the flow of current between the first terminal and the second terminal. Each of the NMOS transistors 18 has its first terminal connected to its gate and connected to the second terminal of an adjacent NMOS transistor. Thus, NMOS transistor 18*c* has its first terminal connected to its gate and connected to the second terminal of the NMOS transistor 18*b*. The second terminal is connected to ground. Similarly, the first terminal of the NMOS transistor 18*b* is connected to its gate and connected to the second terminal of the NMOS transistor 18*a*. The first terminal of the NMOS transistor 18*a* is connected to its gate and connected to the node 20.

The circuit converter 10 also comprises four capacitors designated as C1, C2, C3 and C4. Each of the capacitors is an MOS capacitor made from an MOS transistor having a first terminal and a second terminal connected together as one end of the capacitor and the gate of the MOS transistor as the second end of the capacitor. In the preferred embodiment, capacitor C1, C3 and C4 are made of NMOS transistor and capacitor C2 is made from a PMOS transistor.

The first capacitor C1 has its gate connected to the node 20 and its first and second terminals connected together to ground. The second capacitor C2 is a PMOS transistor having its first and second terminals connected together to Vccext and its gate connected to the output Vccint. The third capacitor C3 has its first and second terminals connected together to ground and its gate connected to Vccint. The fourth capacitor C4 is an NMOS transistor having its first and second terminals connected together to the second terminal of the NMOS transistor 18*a*. The gate of the NMOS transistor forming the capacitor C4 is connected to node 20.

The operation of the circuit converter 10 is as follows: A current, designated as $I_{C1}$ will flow from Vccext through first resistor 14 to node 22, through second resistor 16 to node 20 and through the chain of serially connected NMOS transistors 18(*a–c*) to ground. Thus, the voltage at node 22, designated as $V_{C1}$, is determined by the current $I_{C1}$, times the resistance through the first resistor 14 and subtracted from Vccext. The voltage output of the circuit converter 10, Vccint, is equal to $V_{C1}$ minus the threshold voltage of the NMOS transistor 12. When Vccext increases, the current $I_{C1}$ will also increase. This will then cause a larger voltage drop to occur at node 22. The result is that $V_{C1}$ will not increase as much as Vccext and as a result Vccint will not increase as much when Vccext increases. Similarly, the operation of the circuit converter 10 will generate a Vccint which does not decrease as much if Vccext were to decrease. Thus, the low DC voltage produced Vccint is relatively stable.

The circuit converter 10 of the present invention is also able to compensate for temperature variation. If temperature increases, then $V_{C1}$ at node 22 will decrease. However, when temperature increases, the threshold voltage of the MOS transistor 12 will also decrease. As a result, since the voltage at Vccint is equal to the voltage at node 22 or $V_{C1}$ minus $V_{th}$ of MOS transistor 12, Vccint would increase. In order to reduce this increase, the resistance of the first and second resistors 14 and 16 are chosen such that they each have a positive temperature coefficient. Typically, the resistors are made in an N-well in the semiconductor p-type substrate or well 50. At the same time, however, since each of the MOS transistors 18(*a–c*) of the chain of plurality of serially connected MOS transistors is also of an NMOS type, the voltage threshold will also decrease due to the increase in temperature. In that event, the voltage at node 20 will also drop thereby dropping $V_{C1}$. The result is that Vccint is relatively stable and is immune to changes in increase in temperature.

Similarly, if temperature should decrease, then the threshold voltage of MOS transistor 12 will increase and Vccint will decrease. For a drop in temperature, the decrease of resistances of resistors 14 and 16 and the increase of the threshold voltage. of each of the serially connected NMOS transistors 18(*a–c*) will cause the voltage at node 20 to increase. This again makes Vccint stable and immune to decreases in temperature.

The circuit converter 10 of the present invention is also advantageous in that the Vccint generated is relatively immune to processes corner irregularities. In process corner irregularities, if for example, the target for the threshold voltage of the transistor 12 is 0.6 volts, due to process variation, the $V_{th}$ of MOS transistor 12 can have a range from 0.5 volts to 0.7 volts. If the threshold voltage of the MOS transistor 12 is decreased due to process variation, then Vccint will increase. However, because the MOS transistors of the serially connected chain of MOS transistors 18(*a–c*) are also of an MOS type, $V_{th}$ of those transistors will also decrease. This lowers the voltage at node 20, which causes Vccint to decrease. As a result, Vccint is relatively immune to process variations that causes $V_{th}$ to decrease. Similarly, if due to process variations $V_{th}$ of MOS transistor 12 is above the target that is still within the acceptable variation, the action of Vccint decreasing due to the increase in $V_{th}$ of MOS transistor 12 is offset by the voltage at node 20 increasing due to the $V_{th}$ of each of the serially connected NMOS transistors 18(*a–c*) increasing.

In addition, the initial voltage of Vccint can reduce the stress on the gate oxide of the MOS transistor 12. Finally, the positive temperature coefficient of the first and second resistors 14 and 16 can be made very positive such that Vccint at high temperature is less than at low temperature, thereby reducing the semiconductor standby current at high temperature caused by junction leakage.

Further advantages of the circuit converter 10 occur from the use of the capacitors C1–C4. The total decoupling capacitance of the circuit converter 10 is approximately the capacitance of C2 plus C3. During power up, Vccint is initially at approximately C2/(C2+C3)*Vccext. Thus, the capacitor C2 relieves the oxide stress during initial application of Vccext. The capacitor C2 is optional, in that if the difference between Vccext and Vccint is small, the stress on the oxide of MOS transistor 12 will be minimal.

The capacitor C1 stabilizes the voltage at node 20. The capacitor C1 provides an RC time constant (where the resistance for the RC time constant is from the sum of the resistors 14 and 16). The capacitor C1 decouples the ripple from Vccint to the MOS transistor 12 to the voltage at node 22. Thus, the capacitor C1 decouples the noise from Vccext and the noise for the voltage at node 22.

The capacitor C4 serves the same function as capacitor C2, in that the capacitor across the MOS transistor 18*a* serves to decouple the stress across the transistor 18*a* during power up. Finally, the capacitors C2 and C3 serve to decouple noise from Vccint.

What is claimed is:

1. A high DC voltage to low DC voltage circuit converter, for receiving a high DC voltage and for generating a low DC voltage in response thereto, comprising:

a first NMOS transistor having a first terminal, a second terminal and a gate for controlling the flow of current between the first terminal and the second terminal; said first terminal connected to said high DC voltage and said second terminal providing said low DC voltage;

a resistor divider circuit having a first node, a middle node and a second node, said first node connected to said high DC voltage, said middle node connected to said gate of said first NMOS transistor;

said resister divider circuit further comprising a first resistor having a first end and a second end with said first end as said first node;

said resister divider circuit further comprising a second resister having a first end and a second end with said first end connected to said second end of said first resistor, as said middle node, and said second end as said second node;

a plurality of serially connected NMOS transistors having a first end and a second end;

each of said serially connected NMOS transistors having a first terminal, a second terminal and a gate for controlling the flow of current between the first terminal and the second terminal; said first terminal of each of said serially connected NMOS transistors being connected to its gate and its second terminal connected to said first terminal of an adjacent NMOS transistor;

said first terminal of one of said plurality of NMOS transistors being said first end and connected to said second node, and said second end connected to ground; and a first semiconductor capacitor made of a NMOS transistor having a first terminal, a second terminal and a gate, said connected to said second node, and said first terminal and said second terminal connected together to one of the junctions of said first and second terminals in said plurality of serially connected NMOS transistors.

2. The converter of claim 1 further comprising:

a second semiconductor capacitor made of a NMOS transistor having a first terminal, a second terminal and a gate, said gate connected to said gate connected to said second node, and said first terminal and said second terminal connected together to ground.

3. The converter of claim 2 further comprising:

a third semiconductor capacitor made of a NMOS transistor having a first terminal, a second terminal and a gate, said gate connected to said second terminal of said first NMOS transistor, and said first-terminal and said second terminal connected together to ground.

4. The converter of claim 1 wherein said first and second resistors are positive temperature coefficient resistors.

5. The converter of claim 1 wherein said first and second resistors are made in an N-well.

6. A high DC voltage to low DC voltage circuit converter, for receiving a high DC voltage and for generating a low DC voltage in response thereto, comprising:

a first NMOS transistor having a first terminal, a second terminal and a gate for controlling the flow of current between the first terminal and the second terminal; said first terminal connected to said high DC voltage and said second terminal providing said low DC voltage;

a resistor divider circuit having a first node, a middle node and a second node, said first node connected to said high DC voltage, said middle node connected to said gate of said first NMOS transistor;

said resister divider circuit further comprising a first resistor having a first end and a second end with said first end as said first node;

said resister divider circuit further comprising a second resister having a first end and a second end with said first end connected to said second end of said first resistor, as said middle node, and said second end as said second node;

a plurality of serially connected NMOS transistors having a first end and a second end;

each of said serially connected NMOS transistors having a first terminal, a second terminal and a gate for controlling the flow of current between the first terminal and the second terminal; said first terminal of each of said serially connected NMOS transistors being connected to its gate and its second terminal connected to a first terminal of an adjacent NMOS transistor; said first terminal of one of said plurality of NMOS transistors being said first end and connected to said second node, and said second end connected to ground;

a first semiconductor capacitor made of a NMOS transistor having a first terminal, a second terminal and a gate, said gate connected to said second terminal of said first NMOS transistor, and said first terminal and said second terminal connected together to ground; and a second semiconductor capacitor made of a PMOS transistor having a first terminal, a second terminal and a gate, said gate connected to said second terminal of said first NMOS transistor, and said first terminal and said second terminal connected together to said high DC voltage.

7. The converter of claim 6 further comprising:

a third semiconductor capacitor made of a NMOS transistor having a first terminal, a second terminal and a gate, said gate connected to said second node, and said first terminal and said second terminal connected together to ground.

8. The converter of claim 7 further comprising:

a fourth semiconductor capacitor made of a NMOS transistor having a first terminal, a second terminal and a gate, said gate connected to said second node, and said first terminal and said second terminal connected together to one of the junctions of said first and second terminals in said plurality of serially connected NMOS transistors.

9. The converter of claim 6 wherein said first and second resistors are positive temperature coefficient resistors.

10. The converter of claim 6 wherein said first and second resistors are made in an N-well.

* * * * *